US007284980B2

(12) United States Patent
Saijo et al.

(10) Patent No.: US 7,284,980 B2
(45) Date of Patent: Oct. 23, 2007

(54) CONTINUOUS FIRING FURNACE, MANUFACTURING METHOD OF POROUS CERAMIC MEMBER USING THE SAME, POROUS CERAMIC MEMBER, AND CERAMIC HONEYCOMB FILTER

(75) Inventors: Takamitsu Saijo, Ibi-gun (JP); Kenichiro Kasai, Ibi-gun (JP)

(73) Assignee: Ibiden Co., Ltd., Ogaki-shi (JP)

( * ) Notice: Subject to any disclaimer, the term of this patent is extended or adjusted under 35 U.S.C. 154(b) by 189 days.

(21) Appl. No.: 11/156,569

(22) Filed: Jun. 21, 2005

(65) Prior Publication Data

US 2006/0029897 A1 Feb. 9, 2006

(30) Foreign Application Priority Data

Aug. 4, 2004 (JP) ..... 2004-228648
Feb. 18, 2005 (JP) ..... PCT/JP05/02609

(51) Int. Cl.
*F27B 11/00* (2006.01)

(52) U.S. Cl. ..... 432/206; 432/247; 432/146

(58) Field of Classification Search ..... 432/206, 432/121, 128, 132, 143, 146, 247; 264/630; 126/91 A See application file for complete search history.

(56) References Cited

U.S. PATENT DOCUMENTS 2,099,967 A * 11/1937 Leonard et al. ..... 432/213
3,282,578 A 11/1966 Ulbrich
3,837,794 A * 9/1974 Phillips ..... 432/8
4,060,377 A * 11/1977 Hentz et al. ..... 432/50
4,376,342 A 3/1983 Gavioli
4,444,557 A * 4/1984 Kimura et al. ..... 432/136
4,568,279 A * 2/1986 Logue et al. ..... 432/206
4,615,676 A * 10/1986 Corato ..... 432/9
5,271,545 A * 12/1993 Boswell et al. ..... 228/43
5,914,187 A 6/1999 Naruse et al.
5,930,994 A 8/1999 Shimato et al.
6,447,564 B1 9/2002 Ohno et al.
6,530,780 B2 * 3/2003 Mori et al. ..... 432/121
6,565,630 B2 5/2003 Ohno et al.
6,669,751 B1 12/2003 Ohno et al.
6,770,116 B2 8/2004 Kojima (Continued)

FOREIGN PATENT DOCUMENTS

EP 0 248 918 A1 12/1987

(Continued)

*Primary Examiner*—Gregory Wilson
(74) *Attorney, Agent, or Firm*—Oblon, Spivak, McClelland, Maier & Neustadt, P.C.

(57) ABSTRACT

A continuous firing furnace of the present invention comprises: a muffle formed into a cylindrical shape so as to ensure a predetermined space; a plurality of heat generators placed at the peripheral direction from the muffle; and a heat insulating layer formed in a manner so as to enclose said muffle and said heat generators therein, said continuous firing furnace being configured such that a formed body to be fired, which is transported from an inlet side, passes through the inside of said muffle at a predetermined speed in an inert gas atmosphere and, then, is discharged from an outlet so that said formed body is fired, wherein said inert gas flows through: a space between said muffle and said heat insulating layer; and a space inside the muffle, in sequence.

52 Claims, 7 Drawing Sheets

U.S. PATENT DOCUMENTS

| | | | |
|---|---|---|---|
| 6,939,825 | B1 | 9/2005 | Ohno et al. |
| 2004/0031264 | A1 | 2/2004 | Kojima |
| 2004/0033175 | A1 | 2/2004 | Ohno et al. |
| 2004/0055265 | A1 | 3/2004 | Ohno et al. |
| 2004/0161596 | A1 | 8/2004 | Taoka et al. |
| 2004/0223892 | A1 | 11/2004 | Kojima |
| 2005/0011174 | A1 | 1/2005 | Hong et al. |
| 2005/0016140 | A1 | 1/2005 | Komori et al. |
| 2005/0016141 | A1 | 1/2005 | Hong et al. |
| 2005/0076626 | A1 | 4/2005 | Kudo et al. |
| 2005/0102987 | A1 | 5/2005 | Kudo |
| 2005/0109023 | A1 | 5/2005 | Kudo et al. |
| 2005/0115224 | A1 | 6/2005 | Kojima |
| 2005/0153099 | A1 | 7/2005 | Yamada |
| 2005/0159310 | A1 | 7/2005 | Ohno et al. |
| 2005/0160710 | A1 | 7/2005 | Taoka et al. |
| 2005/0161849 | A1 | 7/2005 | Ohno et al. |
| 2005/0169818 | A1 | 8/2005 | Ohno et al. |
| 2005/0169819 | A1 | 8/2005 | Shibata |
| 2005/0175514 | A1 | 8/2005 | Ohno |
| 2005/0176581 | A1 | 8/2005 | Ohno et al. |
| 2005/0178098 | A1 | 8/2005 | Ono et al. |
| 2005/0180898 | A1 | 8/2005 | Yamada |
| 2005/0214504 | A1 | 9/2005 | Yoshida |
| 2005/0229565 | A1 | 10/2005 | Yoshida |
| 2005/0235621 | A1 | 10/2005 | Kunieda et al. |
| 2005/0247038 | A1 | 11/2005 | Takahashi |
| 2005/0272602 | A1 | 12/2005 | Ninomiya |
| 2006/0019061 | A1 | 1/2006 | Oshimi |
| 2006/0029898 | A1 | 2/2006 | Saijo et al. |
| 2006/0032203 | A1 | 2/2006 | Komori et al. |
| 2006/0043652 | A1 | 3/2006 | Saijo et al. |
| 2006/0059877 | A1 | 3/2006 | Yoshida |
| 2006/0108347 | A1 | 5/2006 | Koyama et al. |
| 2006/0118546 | A1 | 6/2006 | Saijo |
| 2006/0245465 | A1 | 11/2006 | Saijo et al. |
| 2007/0085233 | A1 | 4/2007 | Yamada |
| 2007/0144561 | A1 | 6/2007 | Saijo et al. |
| 2007/0148403 | A1 | 6/2007 | Yamamura et al. |
| 2007/0152382 | A1 | 7/2007 | Yamada et al. |

FOREIGN PATENT DOCUMENTS

| | | |
|---|---|---|
| EP | 0 294 066 A2 | 12/1988 |
| JP | 1-167584 | 7/1989 |
| JP | 1-290562 | 11/1989 |
| JP | 06-317380 | 11/1994 |
| JP | 10-52618 | 2/1998 |
| JP | 10-141859 | 5/1998 |
| JP | 2001-48657 | 2/2001 |
| JP | 2002-20173 | 1/2002 |
| JP | 2002-20174 | 1/2002 |
| JP | 2002-97076 | 4/2002 |
| JP | 2002-249385 | 9/2002 |
| JP | 2003-314964 | 11/2003 |

* cited by examiner

B-B Line cross-sectional view

CONTINUOUS FIRING FURNACE, MANUFACTURING METHOD OF POROUS CERAMIC MEMBER USING THE SAME, POROUS CERAMIC MEMBER, AND CERAMIC HONEYCOMB FILTER

CROSS-REFERENCE TO RELATED APPLICATIONS

This application claims benefit of priority to Japanese Patent Application No. 2004-228648, filed on Aug. 4, 2004, and PCT Application No. PCT/JP2005/002609 filed on Feb. 18, 2005, the contents of which are incorporated by reference herein in their entirety.

BACKGROUND OF THE INVENTION

1. Field of the Invention

The present invention relates to a continuous firing furnace and a manufacturing method of a porous ceramic member using the same, porous ceramic member, and ceramic honeycomb filter.

2. Discussion of the Background

There have been proposed various exhaust gas purifying honeycomb filters and catalyst supporting bodies which are used for purifying exhaust gases discharged from internal combustion engines of vehicles, such as a bus, a truck and the like, and construction machines and the like.

With respect to such an exhaust gas purifying honeycomb filter and the like, there has been used a honeycomb structural body made of a non-oxide ceramic porous material such as silicon carbide or the like having superior heat resistance.

Conventionally, upon firing a ceramic member of this type, there has been used a firing furnace the inner atmosphere of which can be set to an inert gas atmosphere or the like.

With respect to the firing furnace of this type, JP-A 1-290562 (1989) has disclosed a method in which firing containers, each housing an object to be fired, are piled up in multiple stages so that the objects are fired in the firing furnace. Herein, with respect to the firing container, a firing container which has a material chamber for housing the object to be fired and a gas discharging chamber is used, and a gas supplied to the firing furnace is introduced into the material chamber and the gas discharging chamber of the firing container, with the pressure of the gas inside the material chamber being maintained higher than the pressure of the gas inside the gas discharging pressure.

Moreover, JP-A 2003-314964 has disclosed an atmospheric firing furnace that comprises a gas exchanging furnace at each of the inlet and the outlet of the firing furnace. This firing furnace has a valve that is used upon opening an air-sealing door placed between the firing furnace main body and a gas exchange chamber so as to set the firing furnace main body and the gas exchange chamber to the same pressure, so that the opening and closing operations of the door are easily carried out.

However, the firing method disclosed in JP-A 1-290562 (1989) mainly describes a method as to how to allow the gas to flow through the inside of the firing container (jig-for-firing), and this method does not describe anything about atmospheric gas flows with respect to the entire firing furnace. Moreover, FIG. 5 of JP-A 1-290562 (1989) shows only gas flow directions in a space (hereinafter, referred to as muffle) in which an object to be fired is directly placed, such as the inside of the muffle or the like, and does not show anything about atmospheric gas flows including portions outside of the muffle.

The contents of Japanese Patent Laid-open Publication No. 1-290562 (1989) and Japanese Patent Laid-open Publication No. 2003-314964 are incorporated herein by reference in their entirety.

SUMMARY OF THE INVENTION

A continuous firing furnace in accordance with a first aspect of the present invention comprises: a muffle formed into a cylindrical shape so as to ensure a predetermined space; a plurality of heat generators placed at the peripheral direction from the muffle; and a heat insulating layer formed in a manner so as to enclose the muffle and the heat generators therein, the continuous firing furnace being configured such that a formed body to be fired, which is transported from an inlet side, passes through the inside of the muffle at a predetermined speed in an inert gas atmosphere and, then, is discharged from an outlet so that the formed body is fired. Herein, the inert gas flows through: a space between the muffle and the heat insulating layer; and a space inside the muffle, in sequence.

A continuous firing furnace in accordance with a second aspect of the present invention comprises a muffle that is formed into a cylindrical shape so as to ensure a predetermined space and functions as a heat generator; and a heat insulating layer formed at the peripheral direction from the muffle, the continuous firing furnace being configured such that a formed body to be fired, which is transported from an inlet side, passes through the inside of the muffle at a predetermined speed in an inert gas atmosphere and, then, is discharged from an outlet so that the formed body is fired. Herein, the inert gas flows: from the heat insulating layer to the muffle; and then from the muffle to a space inside the muffle, in sequence.

In the continuous firing furnace according to the first or second aspect of the present invention, desirably, the inert gas mainly flows from the outlet side toward the inlet side, and the gas in the muffle is discharged: from a high-temperature portion in the furnace; or from a portion sited at the inlet side relative to the high-temperature portion in the furnace.

Moreover, desirably, the above-mentioned continuous firing furnace further comprises a cooling furnace member placed at the outside of the heat insulating layer. Herein, the inert gas desirably flows through: a space between the heat insulating layer and the cooling furnace member; a space between the muffle and the heat insulating layer; and a space inside the muffle, in sequence.

In the above-mentioned continuous firing furnace of the present invention, desirably, the pressure inside the continuous firing furnace is successively lowered in the following order: in the space between the heat insulating layer and the cooling furnace member; in the space between the muffle and the heat insulating layer; and in the space inside the muffle.

The above-mentioned continuous firing furnace desirably comprises: a degassing chamber, a preheating chamber, a heating chamber, a pre-cooling chamber and a cooling chamber. The above-mentioned continuous firing furnace is desirably configured such that: the formed body to be fired, which is transported from the inlet side, passes through the degassing chamber, the preheating chamber, the heating chamber, the pre-cooling chamber, the cooling chamber and the degassing chamber in sequence, and, then, is discharged from the outlet. In the above-mentioned continuous firing furnace, a muffle and a heat insulating layer are desirably formed at least in the heating chamber.

In the continuous firing furnace of the first or second aspect of the present invention, a discharging unit, which discharges gases inside the muffle, desirably has a temperature of about 1000° C. or more.

In the continuous firing furnace of the second aspect of the present invention, an object to be heated is desirably heated by using an induction heating system.

A manufacturing method of a porous ceramic member in accordance with a third aspect of the present invention is the method, upon firing a formed body to form the porous ceramic member, using a continuous firing furnace that comprises: a muffle formed into a cylindrical shape so as to ensure a predetermined space; a plurality of heat generators placed at the peripheral direction from the muffle; and a heat insulating layer formed in a manner so as to enclose the muffle and the heat generators therein, the continuous firing furnace being configured such that the formed body to be fired, which is transported from an inlet side, passes through the inside of the muffle at a predetermined speed in an inert gas atmosphere and, then, is discharged from an outlet so that the formed body is fired, wherein the inert gas flows through: a space between the muffle and the heat insulating layer; and a space inside the muffle, in sequence.

A manufacturing method of a porous ceramic member in accordance with a fourth aspect of the present invention is the method, upon firing a formed body to form the porous ceramic member, using a continuous firing furnace that comprises: a muffle that is formed into a cylindrical shape so as to ensure a predetermined space and functions as a heat generator; and a heat insulating layer formed at the peripheral direction from the muffle, the continuous firing furnace being configured such that a formed body to be fired, which is transported from an inlet side, passes through the inside of the muffle at a predetermined speed in an inert gas atmosphere and, then, is discharged from an outlet so that the formed body is fired, wherein the inert gas flows: from the heat insulating layer to the muffle; and then from the muffle to a space inside the muffle in sequence.

In the manufacturing method of a porous ceramic member according to the third or fourth aspect of the present invention, in the muffle of the continuous firing furnace, desirably, the inert gas mainly flows from the outlet side toward the inlet side, and the gas in the muffle of the continuous firing furnace is discharged: from a high-temperature portion in the furnace; or from a portion sited at the inlet side relative to the high-temperature portion in the furnace.

In the manufacturing method of a porous ceramic member according to the third or fourth aspect of the present invention, desirably, the continuous firing furnace further comprises a cooling furnace member placed at the outside of the heat insulating layer. Herein, the inert gas desirably flows through: a space between the heat insulating layer and the cooling furnace member; a space between the muffle and the heat insulating layer; and a space inside the muffle, in sequence.

In the manufacturing method of a porous ceramic member according to the third or fourth aspect of the present invention, the pressure inside said continuous firing furnace is desirably lowered: in the space between the heat insulating layer and the cooling furnace member; in the space between the muffle and the heat insulating layer; and in the space inside the muffle, in sequence.

In the manufacturing method of a porous ceramic member according to the third or fourth aspect of the present invention, a discharging unit, which discharges gases inside the muffle, desirably has a temperature of about 1000° C. or more.

In the manufacturing method of a porous ceramic member according to the fourth aspect of the present invention, the formed body is desirably heated by using an induction heating system.

A porous ceramic member according to the fifth aspect of the present invention is a porous ceramic member manufactured by firing a formed body, upon firing the formed body, the porous ceramic member being manufactured by using a firing furnace that comprises: a muffle formed into a cylindrical shape so as to ensure a predetermined space; a plurality of heat generators placed at the peripheral direction from the muffle; and a heat insulating layer formed in a manner so as to enclose the muffle and the heat generators therein, wherein the continuous firing furnace is configured such that a formed body to be fired, which is transported from an inlet side, passes through the inside of the muffle at a predetermined speed in an inert gas atmosphere and, then, is discharged from an outlet so that the formed body is fired, and the inert gas flows through: a space between the muffle and the heat insulating layer; and a space inside the muffle, in sequence.

A porous ceramic member according to the sixth aspect of the present invention is a porous ceramic member manufactured by firing a formed body, upon firing the formed body, the porous ceramic member being manufactured by using a firing furnace that comprises: a muffle that is formed into a cylindrical shape so as to ensure a predetermined space, and functions as a heat generator; and a heat insulating layer formed at the peripheral direction from the muffle, wherein the continuous firing furnace is configured such that a formed body to be fired, which is transported from an inlet side, passes through the inside of the muffle at a predetermined speed in an inert gas atmosphere and, then, is discharged from an outlet so that the formed body is fired, and the inert gas flows from the heat insulating layer to the muffle and from the muffle to a space inside the muffle in sequence.

In a porous ceramic member according to the fifth or sixth aspect of the present invention, the continuous firing furnace is desirably configured such that: in the muffle, the inert gas mainly flows from the outlet side toward the inlet side, and the continuous firing furnace is desirably configured such that: in the muffle, the gas is discharged: from a high-temperature portion in the furnace; or from a portion sited at the inlet side relative to the high-temperature portion in the furnace.

In a porous ceramic member according to the fifth or sixth aspect of the present invention, the continuous firing furnace further desirably comprises a cooling furnace member placed at the outside of the heat insulating layer, and the continuous firing furnace is desirably configured such that the inert gas flows through: a space between the heat insulating layer and the cooling furnace member; a space between the muffle and the heat insulating layer; and a space inside the muffle, in sequence.

In a porous ceramic member according to the fifth or sixth aspect of the present invention, the pressure inside the continuous firing furnace is desirably lowered: in the space between the heat insulating layer and the cooling furnace member; in the space between the muffle and the heat insulating layer; and in the space inside the muffle, in sequence.

A ceramic honeycomb filter according to the seventh aspect of the present invention is obtained by using the porous ceramic member according to the fifth aspect of the present invention.

A honeycomb filter according to the eighth aspect of the present invention is obtained by using the porous ceramic member according to the sixth aspect of the present invention.

In a ceramic honeycomb filter according to the seventh or eighth aspect of the present invention, the continuous firing furnace is desirably configured such that: in the muffle, the inert gas mainly flows from the outlet side toward the inlet side, and the continuous firing furnace is desirably configured such that: in the muffle, the gas is discharged: from a high-temperature portion in the furnace; or from a portion sited at the inlet side relative to the high-temperature portion in the furnace.

In a ceramic honeycomb filter according to the seventh or eighth aspect of the present invention, desirably, the continuous firing furnace further comprises a cooling furnace member placed at the outside of the heat insulating layer, and the continuous firing furnace is desirably configured such that the inert gas flows through: a space between the heat insulating layer and the cooling furnace member; a space between the muffle and the heat insulating layer; and a space inside the muffle, in sequence.

DESCRIPTION OF THE EMBODIMENTS

The continuous firing furnace according to the first aspect of the present invention comprises: a muffle formed into a cylindrical shape so as to ensure a predetermined space; a plurality of heat generators placed at the peripheral direction from the muffle; and a heat insulating layer formed in a manner so as to enclose the muffle and the heat generators therein, the continuous firing furnace being configured such that a formed body to be fired, which is transported from an inlet side, passes through the inside of the muffle at a predetermined speed in an inert gas atmosphere and, then, is discharged from an outlet so that the formed body is fired. Herein, the inert gas flows through: a space between the muffle and the heat insulating layer; and a space inside the muffle, in sequence.

Figure 1A:
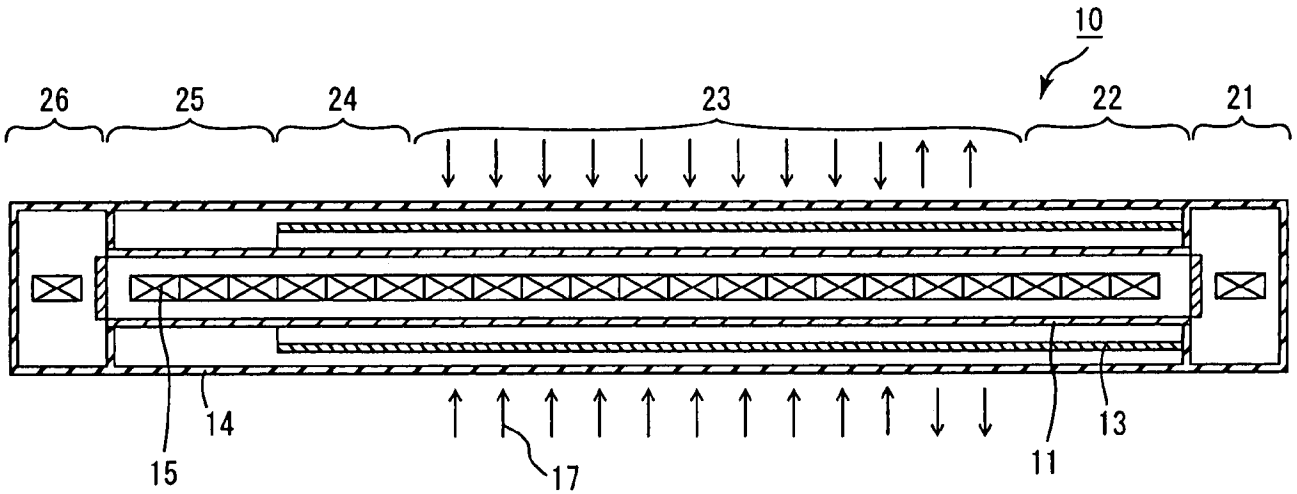
FIG. 1A is a horizontal cross-sectional view that shows a cross section in which a continuous firing furnace according to the first aspect of the present invention is horizontally cut in the length direction.
Figure 1B:
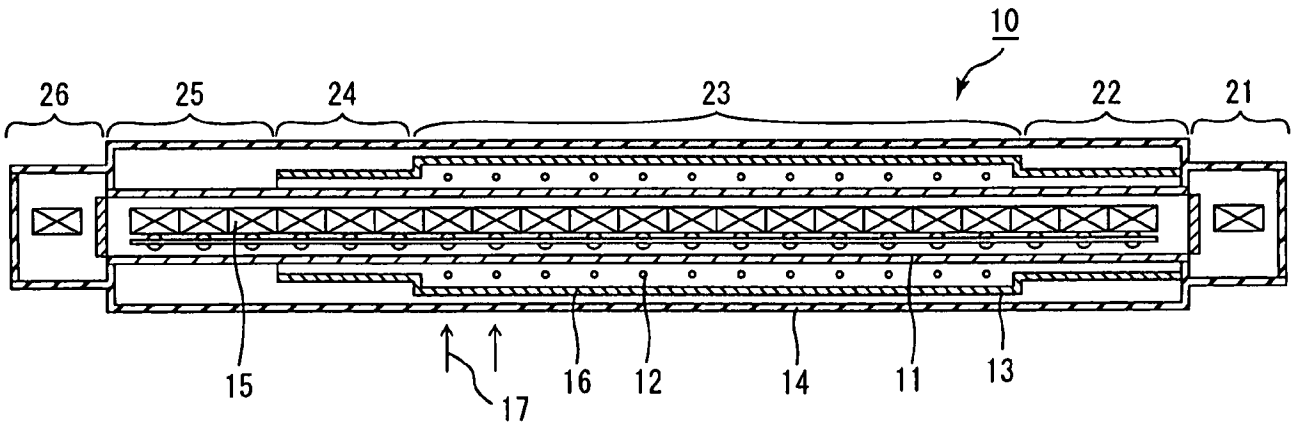
FIG. 1B is a longitudinal cross-sectional view that shows a cross section in which the continuous firing furnace shown in FIG. 1A is longitudinally cut in the length direction.

FIG. 1A is a horizontal cross-sectional view that shows a cross section in which the continuous firing furnace according to the present invention is horizontally cut in the length direction, and FIG. 1B is a longitudinal cross-sectional view that shows across section in which the continuous firing furnace shown in FIG. 1A is longitudinally cut in the length direction.

Figure 2:
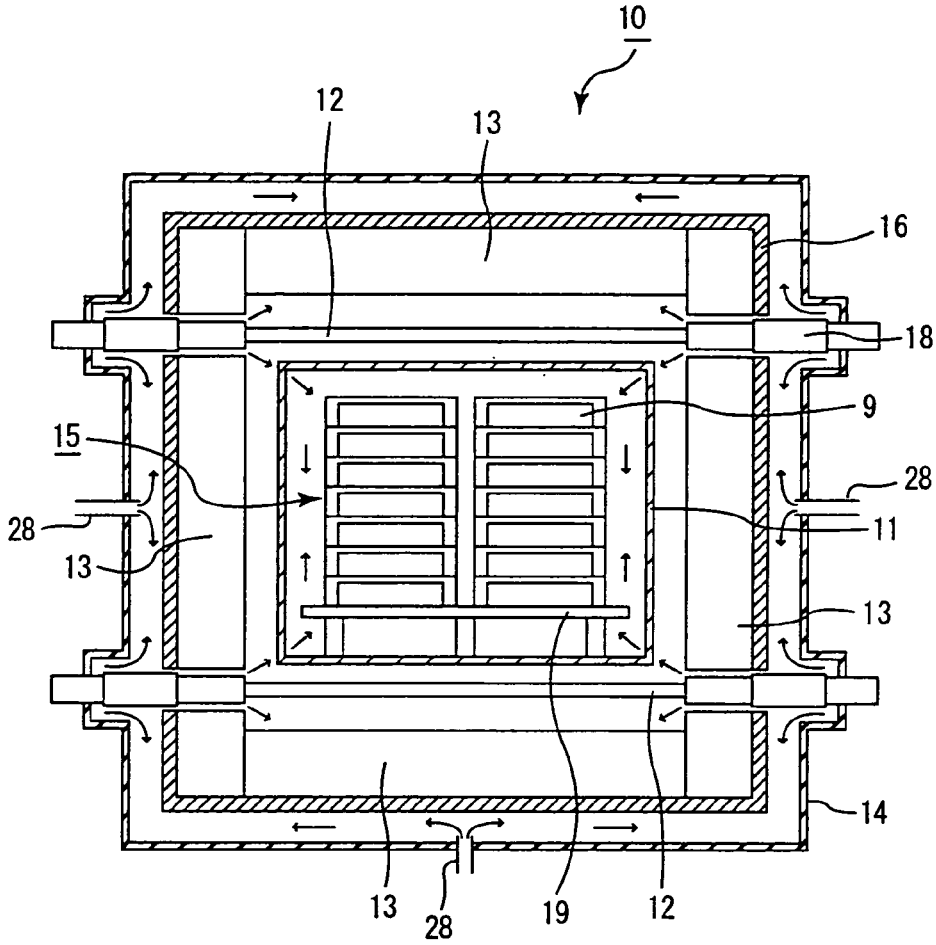
FIG. 2 is a longitudinal cross-sectional view that shows a cross section in which a heating chamber of the continuous firing furnace according to the first aspect of the present invention is cut in the width direction.
Figure 3:
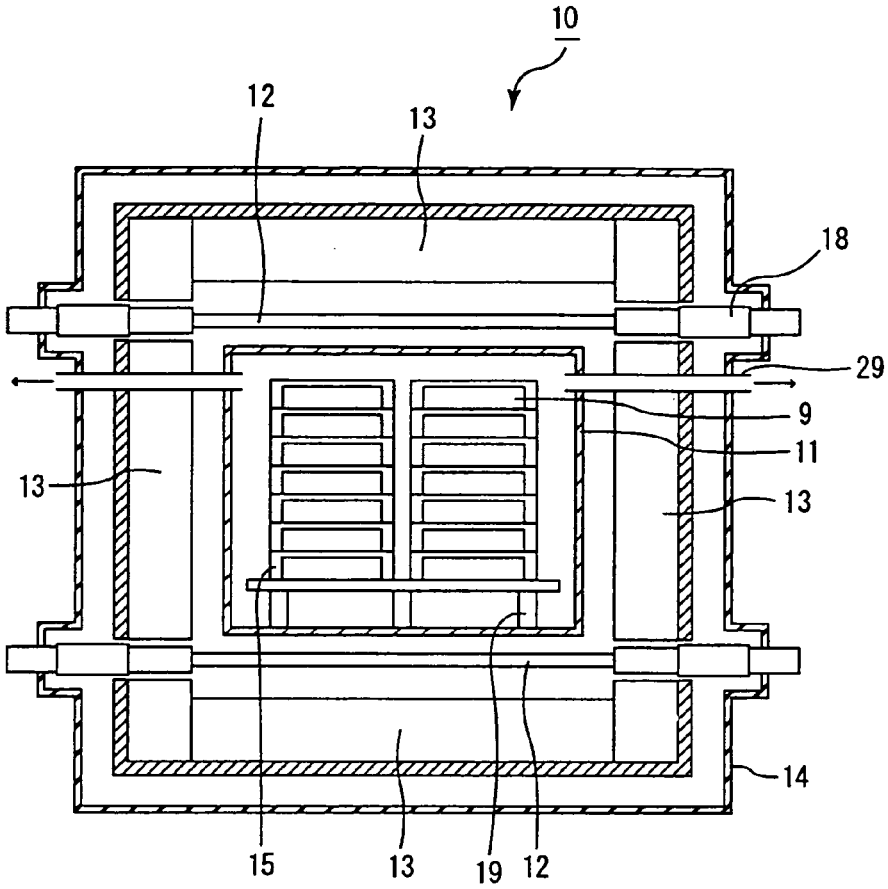
FIG. 3 is a longitudinal cross-sectional view that shows a cross section in which a preheating chamber of the continuous firing furnace according to the first aspect of the present invention is cut in the width direction.

FIG. 2 is a longitudinal cross-sectional view that shows a cross section in which a heating chamber of the continuous firing furnace of the present invention is cut in the width direction, and FIG. 3 is a longitudinal cross-sectional view that shows a cross section in which a preheating chamber of the continuous firing furnace of the present invention is cut in the width direction.

A heating chamber 23 of the continuous firing furnace 10 according to the first aspect of the present invention is provided with a cylindrical muffle 11 that is formed so as to ensure a space for housing a jig-for-firing piled-up body 15 in which formed bodies 9 to be fired are installed, heaters 12 that are placed above and below the muffle 11 with predetermined intervals, a heat insulating layer 13 that is placed in a manner so as to enclose the muffle 11 and the heaters 12 therein, a heat insulating layer attaching-enclosing member 16, placed outside the heat insulating layer 13, to which the heat insulating layer 13 is attached, and a cooling furnace member (water-cooling jacket) 14 that is placed outside the heat insulating layer attaching-enclosing member 16. The heating chamber 23 is separated from the ambient atmosphere by the cooling furnace member 14. In this embodiment, the heaters 12 are placed above and below the muffle 11; however, the present invention is not intended to be limited by this structure, and the heaters 12 may be placed at any desired positions, as long as they are located at the peripheral direction from the muffle 11. Moreover, the cooling furnace member 14 has a structure which keeps the temperature of the furnace member at a predetermined temperature by allowing a fluid such as water or the like to flow the inside thereof, and is placed at the outermost periphery of the continuous firing furnace 10.

The entire floor portion of the muffle 11 is supported by a supporting member (not shown) so that the jig-for-firing piled-up body 15, in which formed bodies to be fired are installed, passes through it. The muffle 11 is formed on the entire area except for degassing chambers 21 and 26.

The heaters 12, made of graphite or the like, are placed above and below the muffle 11 with predetermined intervals, and these heaters 12 are connected to an outside power supply (not shown) through terminals 18. The heaters 12 are placed in a heating chamber 23 as well as in a preheating chamber 22, if necessary.

The heat insulating layers 13 are placed outside the preheating chamber 22, the heating chamber 23 and an pre-cooling chamber 24, and in the heating chamber 23, the heat insulating layer 13 is placed further outside the heater 12, and the heat insulating layer 13 is attached to the heat insulating layer attaching-enclosing member 16 placed immediately outside thereof, and fixedly secured thereto. Moreover, the cooling furnace member 14 is placed on the entire area except for the degassing chamber 21, on the outermost periphery thereof.

As shown in FIGS. 1A and 1B, this continuous firing furnace 10 is provided with the degassing chamber 21, the preheating chamber 22, the heating chamber 23, the pre-cooling chamber 24, the cooling chamber 25 and the degassing chamber 26 that are placed in this order from the inlet.

The degassing chamber 21 is placed so as to change the inside and ambient atmospheres of the jig-for-firing piled-up body 15 to be transported therein, and after the jig-for-firing piled-up body 15 has been placed on the supporting body 19 or the like and transported therein, the degassing chamber 21 is vacuumed so that an inert gas is successively directed thereto; thus, the inside and ambient atmospheres of the jig-for-firing piled-up body 15 are changed into inert gas atmospheres.

In the preheating chamber 22, the temperature of the jig-for-firing piled-up body 15 is gradually raised by using a heater or utilizing heat of the heating chamber, and the firing process is carried out in the heating chamber 23. In the pre-cooling chamber 24, after the firing process, the jig-for-firing piled-up body 15 is gradually cooled, and further cooled in the cooling chamber 25 to a temperature close to room temperature. After the jig-for-firing piled-up body 15 has been transported to the degassing chamber 26, air is introduced thereto by releasing the inert gas, and the jig-for-firing piled-up body 15 is taken out.

Moreover, in the degassing chambers 21 and 26, it is necessary to adjust the pressure of the degassing chamber 21 so as not to release the inert gas toward the preheating chamber 22 and the cooling chamber 25 from the degassing chambers 21 and 26, upon opening a door to each of the preheating chamber 22 and the cooling chamber 25. In the case where, upon opening the doors to the preheating chamber 22 and the cooling chamber 25, the inert gas is released toward the preheating chamber 22 and the cooling chamber 25 from the degassing chambers 21 and 26, the pressure inside the muffle 11 increases and the gas inside the muffle 11 flows outward from the muffle 11; thus, oxygen and the like, generated from the formed body and the like, are released outside the muffle 11 to cause corrosion and the like in the heater 12, the insulating layer 13 and the like.

In the present invention, as shown in FIGS. 1A, 1B and 2, inert gas 17 is introduced from the vicinity of the terminals 18 of the heater 12 in the heating chamber 23 as well as from the introduction pipe 28 attached to the cooling furnace member 14 so that the exhaust pipe 29, shown in FIG. 3, is placed at the front side of the preheating chamber 22 or the heating chamber 23 and the inert gas inside the muffle 11 flows toward the inlet from the outlet. In the figures, arrows indicate the flows of the inert gas 17.

With respect to the flowing state of the inert gas inside the heating chamber 23, as shown in FIG. 2, the inert gas is introduced into a space between the heat insulating layer attaching-enclosing member 16 and the cooling furnace member 14 from the introduction pipe 28 placed in the cooling furnace member 14 and, then, is introduced into the inside of the heat insulating layer attaching-enclosing member 16 and further introduced into the muffle 11 through gaps of the insulating layer 13 or the heat insulating layer 13 or through the vicinity of the end portion of the heater 12; thus, the inert gas flows through the space between the heat insulating layer attaching-enclosing member 16 (heat insulating layer 13) and the cooling furnace member 14, a space between the muffle 11 and the heat insulating layer attaching-enclosing member 16 (heat insulating layer 13), and a space inside the muffle 11, in sequence; thus, the pressure inside the continuous firing furnace is gradually lowered in the space between the heat insulating layer attaching-enclosing member 16 (heat insulating layer 13) and the cooling furnace member 14, in the space between the muffle 11 and the heat insulating layer attaching-enclosing member 16 (heat insulating layer 13), as well as in the space inside the muffle 11 in order.

Here, gas transmitting holes (pores) may be formed in the heat insulating layer and the muffle.

Therefore, oxygen and SiO, generated from the formed body and the like in the muffle 11, stay inside the muffle 11 and are prevented from reacting with the heater 12 and the heat insulating layer 13 outside the muffle 11, thereby making it possible to prevent degradation in performances of the heater 12, the heat insulating layer 13 and the like due to corrosion and the like. Moreover, substances other than the above-mentioned substances are prevented from depositing as scales and the like, after having been evaporated and cooled outside the heat insulating layer attaching-enclosing member 16.

Further, the atmospheric gas in the muffle 11 desirably flows from the outlet to the inlet. In this case, since gases generated in the initial stage of the sintering process hardly adhere to portions inside the furnace having high temperatures, it becomes possible to prevent degradation in performances of the heater and the heat insulating layer due to corrosion and the like. Moreover, components, generated from firing materials such as oxygen, SiO and the like, are made to adhere to or react with the fired product that has been sintered so that it becomes possible to prevent degradation in characteristics of the fired product.

Moreover, the gas in the muffle 11 is desirably discharged at a position slightly on the front side (inlet side) from the high-temperature portion inside the furnace or a portion to be the high-temperature portion inside the furnace. This arrangement makes it possible to prevent gases such as oxygen, SiO and the like generated from the formed body from reacting with the furnace member to adhere (deposit) thereto.

The temperature of the exhaust portion is desirably set to a temperature of about 1000° C. or more that makes gases such as oxygen, SiO and the like generated from the formed body hardly react with the furnace member and adhere thereto. The temperature thereof is more desirably set to about 1200° C. or more, further desirably about 1500° C. or more.

According to the continuous firing furnace of the first aspect of the present invention, since the inert gas flows through: a space between the muffle and the heat insulating layer; and a space inside the muffle, in sequence, gases such as oxygen, SiO gas and the like, generated from the object to be fired (formed body or the like) transported inside the muffle, are stopped inside the muffle without reacting with the heater and the heat insulating layer outside the muffle so that it becomes possible to prevent degradation in performances of the heater, the heat insulating layer and the like.

The continuous firing furnace according to the second aspect of the present invention comprises a muffle that is formed into a cylindrical shape so as to ensure a predetermined space and functions as a heat generator; a plurality of heat generators placed inside the muffle; and a heat insulating layer formed at the peripheral direction from the muffle, the continuous firing furnace being configured such that a formed body to be fired, which is transported from an inlet side, passes through the inside of the muffle at a predetermined speed in an inert gas atmosphere and, then, is discharged from an outlet so that the formed body is fired. Herein, the inert gas flows: from the heat insulating layer to the muffle; and then from the muffle to a space inside the muffle, in sequence.

Figure 4A:
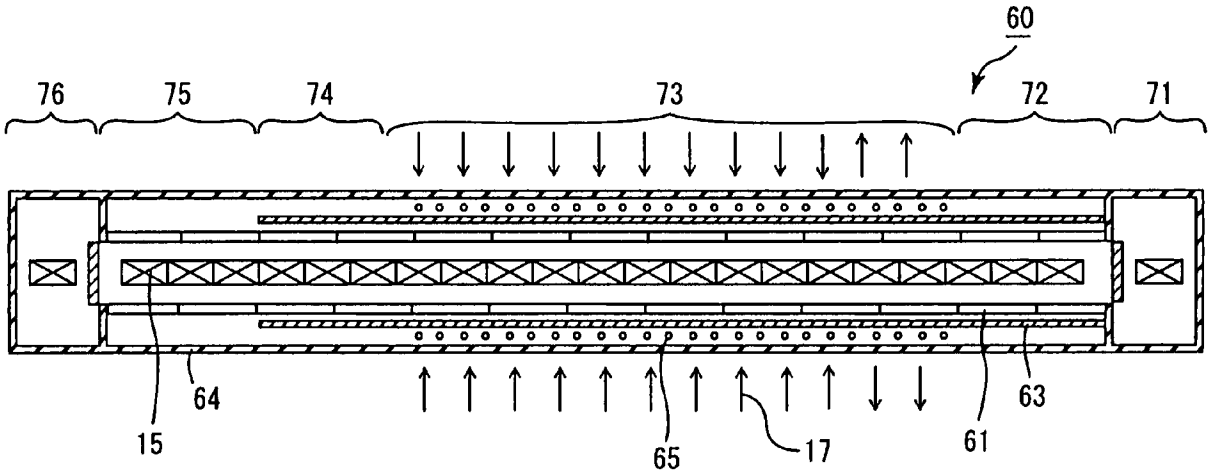
FIG. 4A is a horizontal cross-sectional view that shows a cross section in which a continuous firing furnace according to the second aspect of the present invention is horizontally cut in the length direction.
Figure 4B:
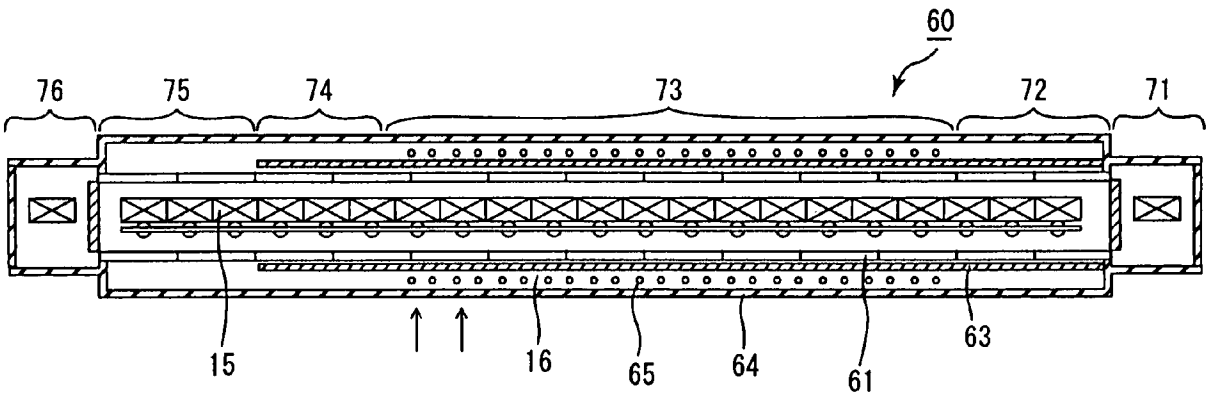
FIG. 4B is a longitudinal cross-sectional view that shows a cross section in which the continuous firing furnace shown in FIG. 4A is longitudinally cut in the length direction.

FIG. 4A is a horizontal cross-sectional view that shows a cross section in which the continuous firing furnace according to the present invention is horizontally cut in the length direction, and FIG. 4B is a longitudinal cross-sectional view that shows a cross section in which the continuous firing furnace shown in FIG. 4A is longitudinally cut in the length direction.

Figure 5:
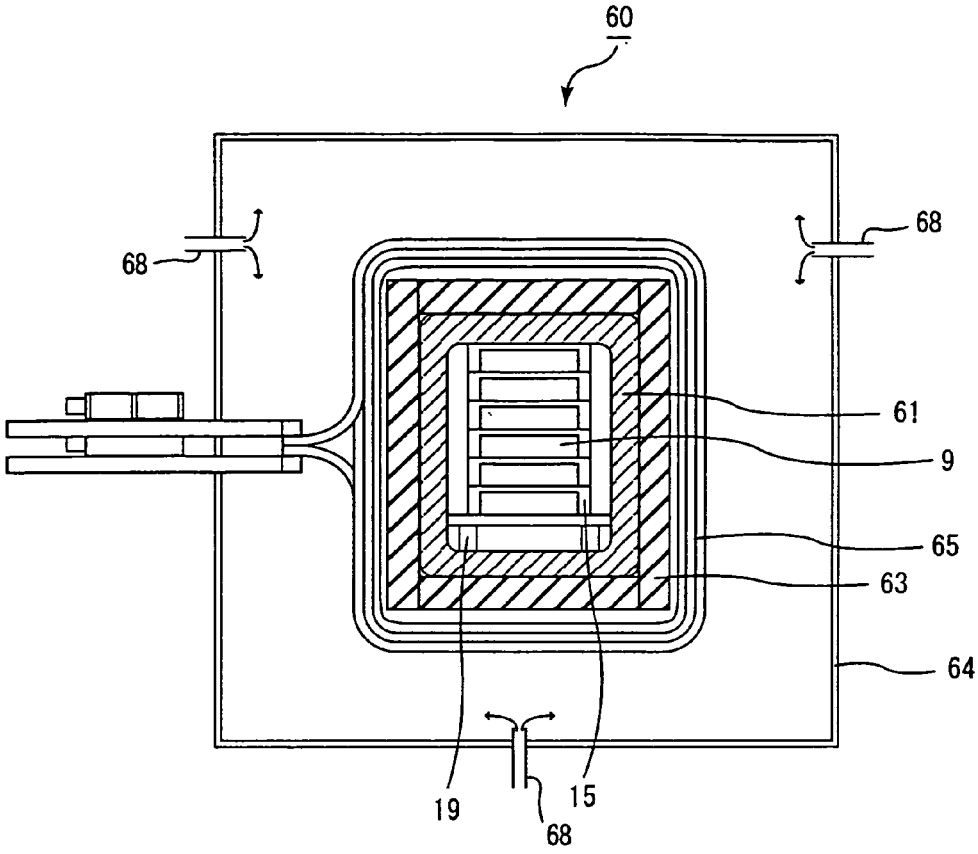
FIG. 5 is a longitudinal cross-sectional view that shows a cross section in which a heating chamber of the continuous firing furnace according to the second aspect of the present invention is cut in the width direction.

FIG. 5 is a longitudinal cross-sectional view that shows a cross section in which the heating chamber of the continuous firing furnace according to the present invention is cut in the width direction.

The continuous firing furnace 60 according to the second aspect of the present invention is a continuous firing furnace using an induction heating system, and a heating chamber 73 is provided with a cylindrical muffle 61 that is formed so as to ensure a space for housing a jig-for-firing piled-up body 15 in which formed bodies 9 to be fired are installed, and functions as a heat generator, a heat insulating layer 63 that is placed at the peripheral direction from the muffle 61, a coil 65 placed outside the heat insulating layer 63, and a cooling furnace member (water-cooling jacket) 64 placed further outside the coil 65. The heating chamber 73 is separated from the ambient atmosphere by the cooling furnace member 64. In the same manner as the continuous firing furnace 10, the cooling furnace member 64 has a structure which keeps the temperature of the furnace member at a predetermined temperature by allowing a fluid such as water or the like to flow the inside thereof, and is placed at the outermost periphery of the continuous firing furnace 60.

This firing furnace 60, which employs the induction heating system, is designed so that, by applying an alternative current to the coil 65, an eddy current is generated in the muffle 61; thus, the temperature of the muffle 61 is raised to function as a heater. Here, another heat generator, which is an electric conductor, may be placed at the peripheral direction from the muffle.

Here, in the case where the object to be heated is an electric conductive material, an electric current is generated so that the object to be heated itself is allowed to generate heat.

In the firing furnace 60, carbon (graphite) is used as the heat generator 62, and upon application of an alternating current to the coil 65, an eddy current is generated to allow the heat generator 62 to generate heat so that the object to be heated such as the formed body 9 or the like is heated. The power of the firing furnace 60 is desirably set in the range of about 300 KWh to about 400 KWh.

As shown in FIGS. 4A and 4B, in the same manner as the continuous firing furnace 10, the continuous firing furnace 60 is provided with a degassing chamber 71, a preheating chamber 72, a heating chamber 73, an pre-cooling chamber 74, a cooling chamber 75 and a degassing chamber 76 that are successively placed from the inlet, and the functions and structures of the respective chambers are approximately the same as those of the continuous firing furnace 10.

In the present invention, as shown in FIGS. 4A, 4B and 5, inert gas is directed from an introduction pipe 68 attached to the cooling furnace member 64, and since the exhaust pipe is placed at the front side of the preheating chamber 72 or the heating chamber 73, the inert gas in the muffle 61 flows from the outlet to the inlet.

Moreover, with respect to the flowing state of the inert gas 17 in the heating chamber 73, as shown in FIG. 5, the inert gas 17 is introduced into a space between the heat insulating layer 63 and the cooling furnace member 64 from the introduction pipe 68 attached to the cooling furnace member 64, and then directed from the heat insulating layer 63 to the muffle 61, and further directed from the muffle 61 to a space inside the muffle 61, in sequence; thus, the pressure inside the continuous firing furnace is gradually lowered in the space between the heat insulating layer 63 and the cooling furnace member 64 and in the space inside the muffle 61, in order. Here, in the case where a slight space is present between the muffle 61 and the heat insulating layer 63, the pressure inside the continuous firing furnace is gradually lowered: in the space between the heat insulating layer 63 and the cooling furnace member 64; in the space between the muffle 61 and the heat insulating layer 63, as well as in the space inside the muffle 61.

Therefore, oxygen, SiO and the like, generated from the formed body and the like in the muffle 61, stays inside the muffle 61 and are prevented from reacting with the heat insulating layer 63 outside the muffle 61, thereby making it possible to prevent degradation in performances of the heat insulating layer 63 and the like due to corrosion and the like. Moreover, substances other than the above-mentioned substances are prevented from being cooled outside the heat insulating layer 63 and depositing as scales and the like, after having been evaporated.

Here, different from the heater 12 of the continuous firing furnace 10, the muffle (heat generator) 61 is formed into not a rod shape, but a face shape having a greater volume; therefore, even if the surface is slightly eroded by oxygen or the like, the amount of heat generation is not changed greatly so that it can be used for a long time.

The firing furnace is desirably configured such that the atmospheric gas in the muffle 61 flows from the outlet to the inlet, and the gas in the muffle 11 is desirably discharged at a position slightly on the front side (inlet side) from the high-temperature portion inside the furnace or a portion to form the high-temperature portion inside the furnace.

The temperature of the exhaust section is desirably set to a temperature of about 1000° C. or more that makes gases such as oxygen, SiO and the like generated from the formed body hardly react with the furnace member and adhere thereto. The temperature thereof is more desirably set to about 1200° C. or more, further desirably about 1500° C. or more. The reason for this arrangement is the same as that described in the continuous firing furnace 10.

According to the continuous firing furnace of the second aspect of the present invention, since the inert gas flows: from the heat insulating layer to the muffle; and then from the muffle to a space inside the muffle, in sequence, gases such as oxygen, SiO gas and the like, generated from the object to be fired (formed body or the like) transported inside the muffle, do not react with the heat insulating layer located outside the muffle, so that it becomes possible to prevent degradation in performances of the heat insulating layer and the like.

In the case where, in the continuous firing furnaces of the first or second aspects of the present invention, the inert gas in the muffle flows from the outlet side toward the inlet side, components such as oxygen, SiO and the like, generated from the firing material, are prevented from adhering to or reacting with the fired matter that has been sintered, thereby making it possible to prevent degradation in performances of the heater, the heat insulating layer and the like.

In the case where, in the continuous firing furnaces of the first or second aspects of the present invention, the gas in the muffle is discharged: from a high-temperature portion in the furnace; or from a portion sited at the inlet side relative to the high-temperature portion in the furnace, since gases such as oxygen, SiO gas and the like, generated from the formed body, hardly react with the furnace member to adhere thereto, thereby making it possible to prevent degradation in the furnace member.

With respect to the object to be fired (formed body) in the continuous firing furnace of the first or second aspects of the present invention, not particularly limited, various objects to be fired can be listed.

Desirably, the object to be fired (formed body) is mainly composed of porous ceramics, and examples of the porous ceramic material include nitride ceramics such as aluminum nitride, silicon nitride, boron nitride, and titanium nitride; carbide ceramics such as silicon carbide, zirconium carbide, titanium carbide, tantalum carbide, and tungsten carbide; oxide ceramics such as alumina, zirconia, cordierite, mullite, and silica; and the like.

Moreover, the porous ceramic material may be prepared as a material made of two kinds or more of materials, such as a composite material of silicon and silicon carbide, and the like or may be prepared as oxide ceramics and non-oxide ceramics containing two kinds or more of elements, such as aluminum titanate and the like. With respect to the object to be fired (formed body), a formed body that forms a non-oxide porous ceramic member having high heat resistance, superior mechanical properties and a high thermal conductivity is preferably used, and more preferably, the formed body that forms a silicon carbide porous ceramic member is used.

The silicon carbide porous ceramic member is, for example, used as a ceramic filter, a catalyst supporting body and the like, which purify exhaust gases discharged from an internal combustion engine such as a diesel engine or the like.

Here, the ceramic member to be used as the ceramic filter, the catalyst supporting body and the like is referred to as a honeycomb ceramic body. Also, the honeycomb structural body to be used as the ceramic filter is referred to as a ceramic honeycomb filter.

In the following, description will be given of the honeycomb structural body and a manufacturing method thereof together with a firing process in which the continuous firing furnace of the present invention is used.

The honeycomb structural body has a structure in that a plurality of pillar-shaped porous ceramic members, each having a number of through holes placed in parallel with one another in the length direction with a wall portion interposed therebetween, are bound to one another through sealing material layer. In the following, description will be given of a manufacturing method of a honeycomb structural body in which silicon carbide is used as ceramics; however, the object to be fired in the present invention is not particularly limited to this material.

Figure 6:
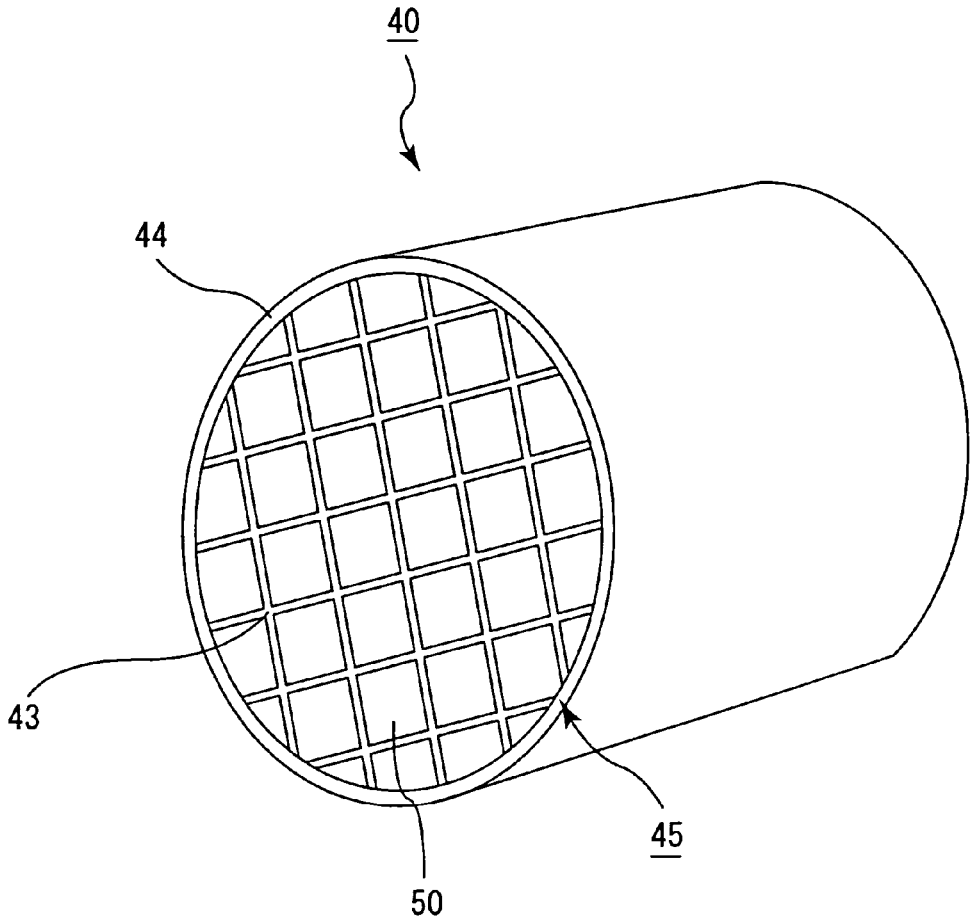
FIG. 6 is a perspective view that schematically shows a honeycomb structural body manufactured by using porous ceramic members made of silicon carbide.

FIG. 6 is a perspective view that schematically shows one example of a honeycomb structural body.

Figure 7A:
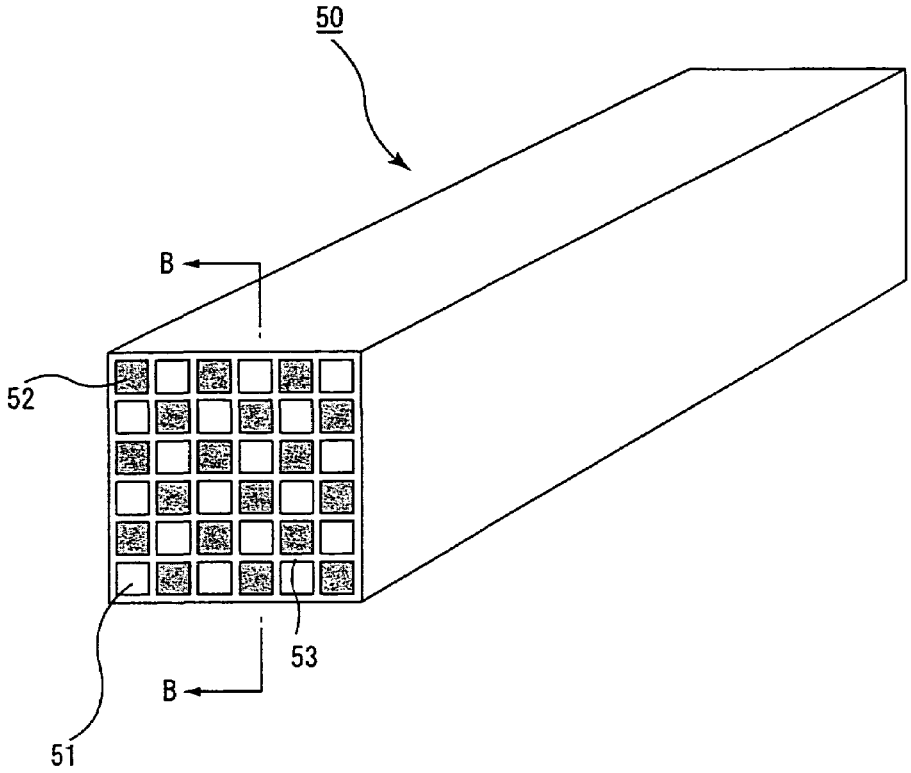
FIG. 7A is a perspective view that schematically shows a porous ceramic member.
Figure 7B:
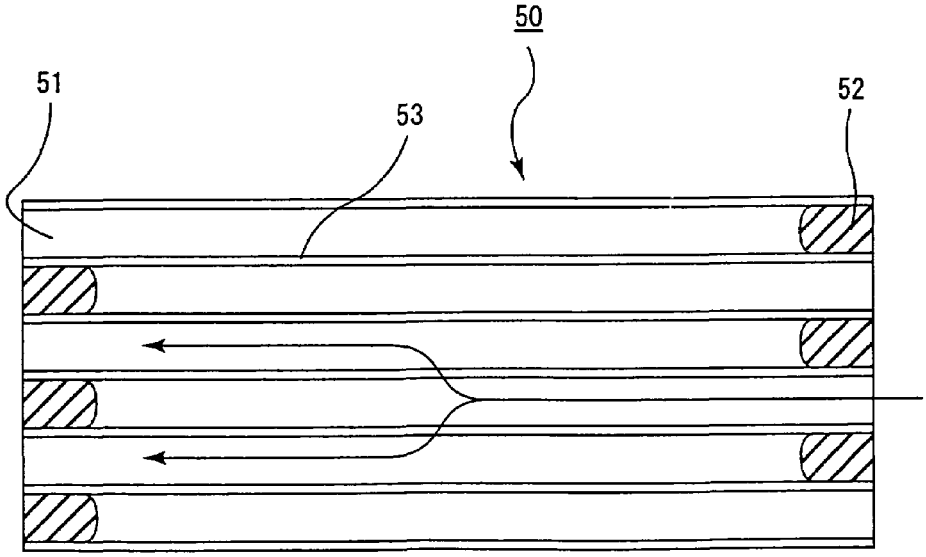
FIG. 7B is a cross-sectional view taken along line B-B of FIG. 7A.

FIG. 7A is a perspective view that schematically shows a porous ceramic member to be used in the honeycomb structural body shown in FIG. 6, and FIG. 7B is a cross-sectional view taken along line B-B of a porous ceramic member shown in FIG. 7A.

A honeycomb structural body 40 has a structure in that a plurality of porous ceramic members 50 made of silicon carbide are bound to one another through sealing material layer 43 to form a ceramic block 45 with a sealing material layer 44 formed on the periphery of the ceramic block 45. Moreover, each porous ceramic member 50 has a structure in that a large number of through holes 51 are placed in parallel with one another in the length direction and the partition wall 53 separating the through holes 51 from each other functions as a filter for collecting particles.

In other words, as shown in FIG. 7B, each of the through holes 51 formed in the porous ceramic member 50 made of porous silicon carbide is sealed with a plug 52 on either one of the ends on the exhaust gas inlet side or the exhaust gas outlet side so that exhaust gases that have entered one of the through holes 51 flow out of another through hole 51 after always passing through the corresponding partition wall 53 that separates the through holes 51; thus, when exhaust gases pass through the partition wall 53, particulates are captured by the partition wall 53 so that the exhaust gases are purified.

Since the honeycomb structural body 40 of this type is superior in heat resistance and capable of easily carrying out a regenerating process and the like, it is used in various large-size vehicles, vehicles with diesel engines and the like.

The sealing material layer 43, which functions as an adhesive layer for bonding the porous ceramic members 50 to each other, may be used as a filter. With respect to the material for the sealing material layer 43, although not particularly limited, approximately the same material as the porous ceramic member 50 is desirably used.

The sealing material layer 44 is placed so as to prevent exhaust gases from leaking through the peripheral portion of each ceramic block 45 when the honeycomb structural body 40 is placed in an exhaust passage of an internal combustion engine. With respect to the material for the sealing material layer 44 also, although not particularly limited, approximately the same material as the porous ceramic member 50 is desirably used.

Here, with respect to the porous ceramic member 50, the end portion of each through hole is not necessarily required to be sealed, and in the case of no sealed end portion, it can be used as a catalyst supporting body on which, for example, a catalyst for converting exhaust gases can be supported.

The porous ceramic member, which is mainly composed of silicon carbide, may be formed by silicon-containing ceramics in which metal silicon is blended in the silicon carbide, ceramics which are bonded by silicon and a silicate compound, or aluminum titanate. As described above, ceramic carbides other than silicon carbide, nitride ceramics and oxide ceramics may also be used for constituting the porous ceramic member.

The average pore diameter of the porous ceramic body 50 is desirably set in the range of about 5 μm to about 100 μm. The average pore diameter of less than about 5 μm tends to cause particulates to easily clog the pore. In contrast, the average pore diameter exceeding about 100 μm tends to cause particulates to pass through the pore, failing to capture particulates, as well as failing to function as a filter. Here, if necessary, metal silicon may be added thereto so as to be set in a range from 0% to about 45% by weight to the total weight so that a part of or the entire ceramic powder is bonded to one another through the metal silicon.

Although not particularly limited, the porosity of the porous ceramic body 50 is desirably set in the range of about 40% to about 80%. When the porosity is less than about 40%, the porous ceramic body tends to be clogged. In contrast, the porosity exceeding about 80% causes degradation in the strength of the pillar-shaped body; thus, it might be easily broken.

With respect to ceramic particles to be used upon manufacturing such a porous ceramic body 50, although not particularly limited, those which are less likely to shrink in the succeeding sintering process are desirably used, and for example, those particles, prepared by combining 100 parts by weight of ceramic particles having an average particle diameter of about 0.3 μm to about 50 μm with about 5 to about 65 parts by weight of ceramic particles having an average particle diameter of about 0.1 μm to about 1.0 μm, are desirably used. By mixing ceramic powders having the above-mentioned respective particle diameters at the above-mentioned blending ratio, it is possible to manufacture a pillar-shaped body made of porous ceramics.

With respect to the shape of the honeycomb structural body 40, not particularly limited to a cylindrical shape as shown in FIG. 6, a pillar shape, such as an elliptical cylindrical shape with a flat shape in its cross section, or a rectangular pillar shape may be used.

Here, the honeycomb structural body 40 can be used as a catalyst supporting member. In this case, a catalyst (catalyst for converting exhaust gases) used for converting exhaust gases is supported on the honeycomb structural body.

By using the honeycomb structural body as a catalyst supporting member, toxic components in exhaust gases, such as HC, CO, NOx and the like, and HC and the like derived from organic components slightly contained in the honeycomb structural body can be surely converted.

With respect to the catalyst for converting exhaust gases, not particularly limited, examples thereof may include noble metals such as platinum, palladium, rhodium and the like. Each of these noble metals may be used alone, or two or more kinds of these may be used in combination.

Next, description will be given of a method for manufacturing a honeycomb structural body.

More specifically, a ceramic piled-up body that forms a ceramic block 45 is first formed (see FIG. 6).

The above-mentioned ceramic piled-up body has a pillar-shaped structure in which a plurality of rectangular pillar-shaped porous ceramic members 50 are bound to one another through sealing material layer 43.

In order to manufacture the porous ceramic member 50 made of silicon carbide, first, a mixed composition is prepared by adding a binder and a dispersant solution to silicon carbide powder, and after this has been mixed by using an attritor or the like, the resulting mixture is sufficiently kneaded by using a kneader or the like so that a pillar-shaped ceramic formed body having approximately the same shape as the porous ceramic member 50 shown in FIGS. 7A and 7B is formed through an extrusion-forming method and the like.

With respect to the particle size of silicon carbide powder, although not particularly limited, such powder that is less likely to shrink in the subsequent sintering process is preferably used, and for example, such powder, prepared by combining 100 parts by weight of silicon carbide powder having an average particle diameter of about 0.3 μm to about 50 μm with about 5 to about 65 parts by weight of silicon ceramic powder having an average particle diameter of about 0.1 μm to about 1.0 μm, is preferably used.

With respect to the above-mentioned binder, not particularly limited, examples thereof may include methyl cellulose, carboxymethyl cellulose, hydroxyethyl cellulose, polyethylene glycol, phenolic resins, epoxy resins and the like.

Normally, the blend ratio of the above-mentioned binder is preferably set to about 1 to about 10 parts by weight with respect to 100 parts by weight of silicon carbide powder.

With respect to the above-mentioned dispersant solution, not particularly limited, for example, an organic solvent such as benzene, alcohol such as methanol, water and the like may be used.

An appropriate amount of the above-mentioned dispersant solution is blended so that the viscosity of the mixed composition is set in a predetermined range.

Next, the silicon carbide formed body is dried, and a mouth-sealing process in which predetermined through holes are filled with plugs is carried out, and the resulting formed body is again subjected to a drying process.

Next, a plurality of silicon carbide formed bodies that have been dried are placed in a jig-for-firing made of carbon, and the firing jigs on which the silicon carbide formed bodies 9 are placed are piled up in a plurality of stages to form a piled-up body 15; thus, the piled-up body 15 is mounted on a supporting base 19 (see FIG. 2).

This supporting base 19 is transported to a degreasing furnace, and heated at about 400° C. to about 650° C. in an oxygen-containing atmosphere so that the degreasing process is carried out to oxidize and eliminate the binder and the like.

Next, the supporting base 19 on which the piled-up body 15 is mounted is transported to the degassing chamber 12 of the continuous firing furnace 10 of the present invention, and after the degassing chamber 21 has been evacuated, the ambient atmosphere of the silicon carbide formed body is changed to an inert gas atmosphere by introducing an inert gas therein.

Thereafter, the supporting base 19, on which the piled-up body 15 is mounted, passes through the preheating chamber 22, the heating chamber 23, the pre-cooling chamber 24 and the cooling chamber 25 successively at a predetermined speed so that a firing process is carried out by heating it at about 1400° C. to about 2200° C. in the inert gas atmosphere so that the ceramic powder is sintered and a porous ceramic member 50 is manufactured, or metal silicon is added to ceramic powder so that a porous ceramic member 50 in which silicon carbide or a part of or the entire silicon carbide is bonded through the metal silicon is manufactured. Thereafter, the supporting base 19 on which the piled-up body 15 is mounted is transported to the degassing chamber 26 so that the gas is exchanged to air at the degassing chamber 26, and then taken out of the continuous firing furnace 10 of the present invention; thus, the firing process is completed.

Next, the plurality of the porous ceramic members 50 manufactured through the above-mentioned processes are bound to one another through the sealing material layer 43, and after the resulting body has been machined into a predetermined shape, the sealing material layer 34 is formed on the periphery thereof; thus, manufacturing processes of the honeycomb structural body are completed.

According to the manufacturing method of a porous ceramic member of the third or fourth aspect of the present invention, upon firing the formed body to form the porous ceramic member, the continuous firing furnace according to the first or second aspect of the present invention is used; therefore, the firing process can be carried out under stable conditions, so that it becomes possible to prevent impurities derived from corrosion and the like of the heat insulating layer from contaminating the product and, consequently, to manufacture a porous ceramic member having superior properties with high reproducibility under the same conditions.

A porous ceramic member of the fifth or sixth aspect of the present invention is the porous ceramic member manufactured by the above-mentioned process. According to the manufacturing method of a porous ceramic member of the fifth or sixth aspect of the present invention, upon firing the formed body to form the porous ceramic member, the continuous firing furnace according to the first or second aspect of the present invention is used; thus, the porous ceramic body which is not contaminated by impurities and exhibits superior characteristics without dispersion is manufactured.

The ceramic honeycomb filter according to the seventh or eighth aspect of the present invention using the porous ceramic body is not contaminated by impurities and exhibits superior characteristics without dispersion.

EXAMPLES

In the following, description will be given of specific examples; however, the present invention is not intended to be limited only by these examples.

Example 1

(1) Powder of α-type silicon carbide having an average particle diameter of 10 μm (60% by weight) and powder of α-type silicon carbide having an average particle diameter of 0.5 μm (40% by weight) were wet-mixed, and to 100 parts by weight of the resulting mixture were added and kneaded 5 parts by weight of an organic binder (methyl cellulose) and 10 parts by weight of water to obtain a mixed composition. Next, after a slight amount of a plasticizer and a lubricant had been added and kneaded therein, the resulting mixture was extrusion-formed so that a silicon carbide formed body was formed.

(2) Next, the above-mentioned silicon carbide formed body was first dried at 100° C. for 3 minutes by using a microwave drier, and then further dried at 110° C. for 20 minutes by using a hot-air drier. After the dried silicon carbide formed body had been cut, the through holes were sealed by using a sealing material (plug) paste made of silicon carbide.

(3) Successively, by using each jig-for-firing which was made of carbon, 10 dried silicon carbide formed bodies 32 were placed therein through base-supporting members made of carbon. Then, these ceramic-firing jigs were piled up in five stages, and a plate-shaped lid was placed on the uppermost portion thereof. Two rows of piled-up bodies of this type were mounted on a supporting base 19.

(4) Next, the firing jigs on which the silicon carbide formed bodies were mounted were transported into a continuous degreasing furnace so that they were heated at 300° C. in a mixed gas atmosphere of air having an oxygen concentration of 8% and nitrogen so as to carry out a degreasing process; thus, silicon carbide degreased bodies were manufactured.

With the silicon carbide degreased bodies mounted on the firing jigs, the firing jigs were transported to the continuous firing furnace 10 of the present invention and subjected to a firing process at 2200° C. in a normal-pressure argon atmosphere for about 3 hours by using the method described in "DESCRIPTION OF THE EMBODIMENTS" so that porous silicon carbide sintered bodies having a square pillar shape were manufactured. Here, with respect to the argon gas, an introduction pipe 28 and an exhaust pipe 29 were placed at positions shown in FIG. 1, and the argon gas was introduced and discharged. The pressure of the degassing chamber 21 was adjusted so that, upon opening the doors of the degassing chambers 21 and 26 on the preheating chamber 22 side as well as on the cooling chamber 25 side, the inert gas does not flow from the degassing chambers 21 and 26 toward the preheating chamber 22 and the cooling chamber 25 (see FIGS. 1A, 1B and 2).

(5) Next, by using a heat resistant sealing material paste that contains 30% by weight of alumina fibers having a fiber length of 20 μm, 21% by weight of silicon carbide particles having an average particle diameter of 0.6 μm, 15% by weight of silica sol, 5.6% by weight of carboxymethyl cellulose and 28.4% by weight of water, 16 (4×4) square-pillar-shaped porous silicon carbide sintered bodies were bound to one another by using the above-mentioned method, and this was then cut by using a diamond cutter to form a cylindrical-shaped ceramic block having a diameter of 144 mm and a length of 150 mm.

After the above-mentioned process, ceramic fibers made of alumina silicate (shot content: 3%, fiber length: 5 to 100 μm) (23.3% by weight), which served as inorganic fibers, silicon carbide powder having an average particle diameter of 0.3 μm (30.2% by weight), which served as inorganic particles, silica sol ($SiO_2$ content in the sol: 30% by weight) (7% by weight), which served as an inorganic binder, carboxymethyl cellulose (0.5% by weight), which served as an organic binder, and water (39% by weight) were mixed and kneaded to prepare a sealing material paste.

Next, a sealing material paste layer of 1.0 mm in thickness was formed on the peripheral portion of the ceramic block by using the sealing material paste. Then, the sealing material paste layer was dried at 120° C. to manufacture a cylindrical-shaped ceramic filter.

In this example, after the manufacturing process of the above-mentioned square-pillar shaped porous silicon carbide sintered body had been continuously carried out for 50 hours, as well as after the manufacturing process had been continuously carried out for 100 hours, the heater 12 and the heat insulating layer 13 were visually observed; however, in any of the cases, no corrosion was found in any of the heater 12 and the heat insulating layer 13, and no deposited matter was found on the outside of the heat insulating layer attaching-enclosing member. Moreover, these members were made into powder and subjected to X-ray diffraction measurements; however, no peak of silicon carbide was observed.

The honeycomb structural body in which the porous ceramic members thus manufactured were used made it possible to sufficiently satisfy properties as a filter, and the honeycomb structural body, which was manufactured by using porous ceramic members that were continuously manufactured, had no change in characteristics as the honeycomb structural body.

Example 2

The same processes as Example 1 were carried out except that an introduction pipe 28 was formed at a position as shown in FIGS. 1A and 1B and that an exhaust pipe 29 was formed at a position (on the further outlet side from the position shown in FIGS. 1A and 1B) which has the temperature of 1800° C. inside the heating chamber 23, with argon gas introduced through the introduction pipe 28 and discharged from the exhaust pipe 29, so that a ceramic filter was manufactured, and evaluation was conducted in the same manner as Example 1.

As a result, after 50 hours of the continuous operating process as well as after 100 hours of the continuous operating process, no corrosion was found in the heater 12 and the heat insulating layer 13, and no deposited matter was found on the outside of the heat insulating layer attaching-enclosing member. Moreover, these members were made into powder and subjected to X-ray diffraction measurements; however, no peak of silicon carbide was observed.

The honeycomb structural body in which the porous ceramic members thus manufactured were used made it possible to sufficiently satisfy properties as a filter, and the honeycomb structural body, which was manufactured by using porous ceramic members that were continuously manufactured, had no change in characteristics as the honeycomb structural body.

Example 3

A ceramic filter was manufactured under the same conditions as Example 1 except that a continuous firing furnace 60 using an induction heating system shown in FIGS. 4A, 4B and 5 was used, and evaluation was conducted in the same manner as Example 1.

As a result, after 50 hours of the continuous operating process as well as after 100 hours of the continuous operating process, no corrosion was found in the heat insulating layer 13.

The honeycomb structural body in which the porous ceramic members thus manufactured were used made it possible to sufficiently satisfy properties as a filter, and the honeycomb structural body, which was manufactured by using porous ceramic members that were continuously manufactured, had no change in characteristics as the honeycomb structural body.

Comparative Example 1

The course of flow of the inert gas in the continuous firing furnace 10 shown in FIGS. 1A, 1B and 2 was changed. In other words, the same processes as Example 1 were carried out, except that the inert gas was introduced into the inside of the muffle so as to flow through the inside of the muffle 11, a space between the muffle 11 and the heat insulating layer 13 and a space between the heat insulating layer 13 and the cooling furnace member 14 in sequence, so that a square pillar-shaped porous silicon carbide sintered body was manufactured.

After the continuous operating process for 50 hours, as well as after the continuous operating process for 100 hours, the heater 12 and the heat insulating layer 13 were visually observed; and, in any of the cases, corrosion was found in the heater 12 and the heat insulating layer 13, and a deposited matter of SiO was also found on the outside of the heat insulating layer attaching-enclosing member. Moreover, these members were made into powder and subjected to X-ray diffraction measurements, and peaks of silicon carbide were observed.

Here, the honeycomb structural body in which the porous ceramic members thus manufactured were used made it possible to sufficiently satisfy properties as a filter, and the honeycomb structural body, which was manufactured by using porous ceramic members that were continuously manufactured, had no change in characteristics as the honeycomb structural body.

Comparative Example 2

The course of flow of the inert gas was changed to a direction completely reversed to the direction of the flow of the inert gas in the continuous firing furnace 10 shown in FIGS. 1A, 1B and 2. In other words, in FIG. 1, at the portion into which the inert gas was introduced, the inert gas was discharged, and at the portion from which the inert gas was discharged, the inert gas was introduced. In this case, the inert gas flew from the inlet side toward the outlet side, that is, the inert gas flew through: a space between the heat insulating layer attaching-enclosing member 16 (heat insulating layer 13) and the cooling furnace member 14; a space between the muffle 11 and the heat insulating layer attaching-enclosing member 16 (heat insulating layer 13); and the inside of the muffle 11, in sequence.

After the continuous manufacturing process of square pillar shaped porous silicon carbide sintered bodies for 50 hours, as well as after the manufacturing process for 100 hours, in the same manner as Example 1 by using the continuous firing furnace 10 in which the gas flow was changed as described above, the heater 12 and the heat insulating layer 13 were visually observed.

As a result, more deposited matter of SiO was found in the muffle on the outlet side in comparison with Example 1, and a part thereof adhered to the product; however, corrosion was hardly found in the heater 12 and the heat insulating layer 13. Moreover, these members were made into powder and subjected to X-ray diffraction measurements, and no peak of silicon carbide was observed.

Here, the honeycomb structural body in which the porous ceramic members thus manufactured were used made it possible to sufficiently satisfy properties as a filter, and the honeycomb structural body, which was manufactured by using porous ceramic members that were continuously manufactured, had no change in characteristics as the honeycomb structural body.

Comparative Example 3

A ceramic filter was manufactured under the same conditions as Comparative Example 1 except that a continuous firing furnace 60 using an induction heating system, as shown in FIGS. 4A, 4B and 5, was used, and evaluation was conducted in the same manner as Example 1.

After the continuous manufacturing process for 50 hours, as well as after the manufacturing process for 100 hours, the heater 12 and the heat insulating layer 13 were visually observed; and, in any of the cases, corrosion was found in the heat insulating layer 13, and a deposited matter of SiO was also found on the outside of the heat insulating layer 13. Moreover, these members were made into powder and subjected to X-ray diffraction measurements, and peaks of silicon carbide were observed.

Here, the honeycomb structural body in which the porous ceramic members thus manufactured were used made it possible to sufficiently satisfy properties as a filter, and the honeycomb structural body, which was manufactured by using porous ceramic members that were continuously manufactured, had no change in characteristics as the honeycomb structural body.

As clearly indicated by the above-mentioned examples, the present invention is suitably applicable to a manufacturing process for a non-oxide-based porous ceramic member.

What is claimed as new and desired to be secured by Letters Patent of the United States is:

1. A continuous firing furnace comprising: a muffle formed into a cylindrical shape so as to ensure a predetermined space; a plurality of heat generators placed at the peripheral direction from the muffle; and a heat insulating layer formed in a manner so as to enclose said muffle and said heat generators therein, said continuous firing furnace being configured such that a formed body to be fired, which is transported from an inlet side, passes through the inside of said muffle at a predetermined speed in an inert gas atmosphere and, then, is discharged from an outlet so that said formed body is fired, wherein said inert gas flows through: a space between said muffle and said heat insulating layer; and a space inside the muffle, in sequence.

2. The continuous firing furnace according to claim 1, wherein said continuous firing furnace is configured such that: in said muffle, the inert gas mainly flows from the outlet side toward the inlet side.

3. The continuous firing furnace according to claim 1, wherein in said muffle, the gas is discharged: from a high-temperature portion in the furnace; or from a portion sited at the inlet side relative to said high-temperature portion in the furnace.

4. The continuous firing furnace according to claim 1, further comprising:

a cooling furnace member placed at the outside of said heat insulating layer, wherein the inert gas flows through: a space between said heat insulating layer and said cooling furnace member; a space between said muffle and said heat insulating layer; and a space inside the muffle, in sequence.

5. The continuous firing furnace according to claim 1, wherein the pressure inside said continuous firing furnace is lowered: in the space between the heat insulating layer and the cooling furnace member; in the space between the muffle and said heat insulating layer; and in the space inside the muffle, in sequence.

6. The continuous firing furnace according to claim 1, wherein a discharging unit, which discharges gases inside said muffle, has a temperature of about 1000° C. or more.

7. The continuous firing furnace according to claim 1, further comprising: a degassing chamber, a preheating chamber, a heating chamber, a pre-cooling chamber and a cooling chamber.

8. The continuous firing furnace according to claim 7, wherein a muffle and a heat insulating layer are formed at least in the heating chamber.

9. The continuous firing furnace according to claim 1, wherein said continuous firing furnace is configured such that: the formed body to be fired, which is transported from the inlet side, passes through the degassing chamber, the preheating chamber, the heating chamber, the pre-cooling chamber, the cooling chamber and the degassing chamber in sequence, and, then, is discharged from the outlet.

10. A continuous firing furnace comprising: a muffle that is formed into a cylindrical shape so as to ensure a predetermined space, and functions as a heat generator; and a heat insulating layer formed at the peripheral direction from said muffle, said continuous firing furnace being configured such that a formed body to be fired, which is transported from an inlet side, passes through the inside of said muffle at a predetermined speed in an inert gas atmosphere and, then, is discharged from an outlet so that said formed body is fired, wherein said inert gas flows from said heat insulating layer to said muffle and from said muffle to a space inside said muffle in sequence.

11. The continuous firing furnace according to claim 10, wherein said continuous firing furnace is configured such that: in said muffle, the inert gas mainly flows from the outlet side toward the inlet side.

12. The continuous firing furnace according to claim 10, wherein in said muffle, the gas is discharged: from a high-temperature portion in the furnace; or from a portion sited at the inlet side relative to said high-temperature portion in the furnace.

13. The continuous firing furnace according to claim 10, further comprising:

a cooling furnace member placed at the outside of said heat insulating layer, wherein the inert gas flows through: a space between said heat insulating layer and said cooling furnace member; a space between said muffle and said heat insulating layer; and a space inside the muffle, in sequence.

14. The continuous firing furnace according to claim 10, wherein the pressure inside said continuous firing furnace is lowered: in the space between the heat insulating layer and the cooling furnace member; in the space between the muffle and said heat insulating layer; and in the space inside the muffle, in sequence.

15. The continuous firing furnace according to claim 10, wherein a discharging unit, which discharges gases inside said muffle, has a temperature of about 1000° C. or more.

16. The continuous firing furnace according to claim 10, wherein an object to be heated is heated by using an induction heating system.

17. The continuous firing furnace according to claim 10, further comprising: a degassing chamber, a preheating chamber, a heating chamber, a pre-cooling chamber and a cooling chamber.

18. The continuous firing furnace according to claim 17, wherein a muffle and a heat insulating layer are formed at least in the heating chamber.

19. The continuous firing furnace according to claim 10, wherein said continuous firing furnace is configured such that: the formed body to be fired, which is transported from the inlet side, passes through the degassing chamber, the preheating chamber, the heating chamber, the pre-cooling chamber, the cooling chamber and the degassing chamber in sequence, and, then, is discharged from the outlet.

20. A manufacturing method of a porous ceramic member, upon firing a formed body to form said porous ceramic member, said method using a continuous firing furnace that comprises: a muffle formed into a cylindrical shape so as to ensure a predetermined space; a plurality of heat generators placed at the peripheral direction from the muffle; and a heat insulating layer formed in a manner so as to enclose said muffle and said heat generators therein, wherein said continuous firing furnace is configured such that a formed body to be fired, which is transported from an inlet side, passes through the inside of said muffle at a predetermined speed in an inert gas atmosphere and, then, is discharged from an outlet so that said formed body is fired, and said inert gas flows through: a space between said muffle and said heat insulating layer; and a space inside the muffle, in sequence.

21. The manufacturing method of a porous ceramic member according to claim 20, wherein said continuous firing furnace is configured such that: in said muffle, the inert gas mainly flows from the outlet side toward the inlet side.

22. The manufacturing method of a porous ceramic member according to claim 20, wherein said continuous firing furnace is configured such that: in said muffle, the gas is discharged: from a high-temperature portion in the furnace; or from a portion sited at the inlet side relative to said high-temperature portion in the furnace.

23. The manufacturing method of a porous ceramic member according to claim 20, wherein said continuous firing furnace further comprises a cooling furnace member placed at the outside of said heat insulating layer, and the inert gas flows through: a space between said heat insulating layer and said cooling furnace member; a space between said muffle and said heat insulating layer; and a space inside the muffle, in sequence.

24. The manufacturing method of a porous ceramic member according to claim 20, wherein the pressure inside said continuous firing furnace is lowered: in the space between the heat insulating layer and the cooling furnace member; in the space between the muffle and said heat insulating layer; and in the space inside the muffle, in sequence.

25. The manufacturing method of a porous ceramic member according to claim 20, wherein a discharging unit, which discharges gases inside said muffle, has a temperature of about 1000° C. or more.

26. A manufacturing method of a porous ceramic member, upon firing a formed body to form said porous ceramic member, said method using a continuous firing furnace that comprises: a muffle that is formed into a cylindrical shape so as to ensure a predetermined space, and functions as a heat generator; and a heat insulating layer formed at the peripheral direction from said muffle, wherein said continuous firing furnace is configured such that a formed body to be fired, which is transported from an inlet side, passes through the inside of said muffle at a predetermined speed in an inert gas atmosphere and, then, is discharged from an outlet so that said formed body is fired, and said inert gas flows from said heat insulating layer to said muffle and from said muffle to a space inside said muffle in sequence.

27. The manufacturing method of a porous ceramic member according to claim 26, wherein said continuous firing furnace is configured such that: in said muffle, the inert gas mainly flows from the outlet side toward the inlet side.

28. The manufacturing method of a porous ceramic member according to claim 26, wherein said continuous firing furnace is configured such that: in said muffle, the gas is discharged: from a high-temperature portion in the furnace; or from a portion sited at the inlet side relative to said high-temperature portion in the furnace.

29. The manufacturing method of a porous ceramic member according to claim 26, wherein said continuous firing furnace further comprises a cooling furnace member placed at the outside of said heat insulating layer, and the inert gas flows through: a space between said heat insulating layer and said cooling furnace member; a space between said muffle and said heat insulating layer; and a space inside the muffle, in sequence.

30. The manufacturing method of a porous ceramic member according to claim 26, wherein the pressure inside said continuous firing furnace is lowered: in the space between the heat insulating layer and the cooling furnace member; in the space between the muffle and said heat insulating layer; and in the space inside the muffle, in sequence.

31. The manufacturing method of a porous ceramic member according to claim 26, wherein a discharging unit, which discharges gases inside said muffle, has a temperature of about 1000° C. or more.

32. The manufacturing method of a porous ceramic member according to claim 26, wherein the formed body is heated by using an induction heating system.

33. A porous ceramic member manufactured by firing a formed body, upon firing said formed body, said porous ceramic member being manufactured by using a firing furnace that comprises: a muffle formed into a cylindrical shape so as to ensure a predetermined space; a plurality of heat generators placed at the peripheral direction from the muffle; and a heat insulating layer formed in a manner so as to enclose said muffle and said heat generators therein, wherein said continuous firing furnace is configured such that a formed body to be fired, which is transported from an inlet side, passes through the inside of said muffle at a predetermined speed in an inert gas atmosphere and, then, is discharged from an outlet so that said formed body is fired, and said inert gas flows through: a space between said muffle and said heat insulating layer; and a space inside the muffle, in sequence.

34. The porous ceramic member according to claim 33, wherein said continuous firing furnace is configured such that: in said muffle, the inert gas mainly flows from the outlet side toward the inlet side.

35. The porous ceramic member according to claim 33, wherein said continuous firing furnace is configured such that: in said muffle, the gas is discharged: from a high-temperature portion in the furnace; or from a portion sited at the inlet side relative to said high-temperature portion in the furnace.

36. The porous ceramic member according to claim 33, wherein said continuous firing furnace further comprises a cooling furnace member placed at the outside of said heat insulating layer, and the inert gas flows through: a space between said heat insulating layer and said cooling furnace member; a space between said muffle and said heat insulating layer; and a space inside the muffle, in sequence.

37. The porous ceramic member according to claim 33, wherein the pressure inside said continuous firing furnace is lowered: in the space between the heat insulating layer and the cooling furnace member; in the space between the muffle and said heat insulating layer; and in the space inside the muffle, in sequence.

38. A ceramic honeycomb filter obtained by using the porous ceramic member according to claim 33.

39. The ceramic honeycomb filter according to claim 38, wherein said continuous firing furnace is configured such that: in said muffle, the inert gas mainly flows from the outlet side toward the inlet side.

40. The ceramic honeycomb filter according to claim 38, wherein said continuous firing furnace is configured such that: in said muffle, the gas is discharged: from a high-temperature portion in the furnace; or from a portion sited at the inlet side relative to said high-temperature portion in the furnace.

41. The ceramic honeycomb filter according to claim 38, wherein said continuous firing furnace further comprises a cooling furnace member placed at the outside of said heat insulating layer, and the inert gas flows through: a space between said heat insulating layer and said cooling furnace member; a space between said muffle and said heat insulating layer; and a space inside the muffle, in sequence.

42. The ceramic honeycomb filter according to claim 38, wherein the pressure inside said continuous firing furnace is lowered: in the space between the heat insulating layer and the cooling furnace member; in the space between the muffle and said heat insulating layer; and in the space inside the muffle, in sequence.

43. A porous ceramic member manufactured by firing a formed body, upon firing said formed body, said porous ceramic member being manufactured by using a firing furnace that comprises: a muffle that is formed into a cylindrical shape so as to ensure a predetermined space, and functions as a heat generator; and a heat insulating layer formed at the peripheral direction from said muffle, wherein said continuous firing furnace is configured such that a formed body to be fired, which is transported from an inlet side, passes through the inside of said muffle at a predetermined speed in an inert gas atmosphere and, then, is discharged from an outlet so that said formed body is fired, and said inert gas flows from said heat insulating layer to said muffle and from said muffle to a space inside said muffle in sequence.

44. The porous ceramic member according to claim 43, wherein said continuous firing furnace is configured such that: in said muffle, the inert gas mainly flows from the outlet side toward the inlet side.

45. The porous ceramic member according to claim 43, wherein said continuous firing furnace is configured such that: in said muffle, the gas is discharged: from a high-temperature portion in the furnace; or from a portion sited at the inlet side relative to said high-temperature portion in the furnace.

46. The porous ceramic member according to claim 43, wherein said continuous firing furnace further comprises a cooling furnace member placed at the outside of said heat insulating layer, and the inert gas flows through: a space between said heat insulating layer and said cooling furnace member; a space between said muffle and said heat insulating layer; and a space inside the muffle, in sequence.

47. The porous ceramic member according to claim 43, wherein the pressure inside said continuous firing furnace is lowered: in the space between the heat insulating layer and the cooling furnace member; in the space between the muffle and said heat insulating layer; and in the space inside the muffle, in sequence.

48. A ceramic honeycomb filter obtained by using the porous ceramic member according to claim 43.

49. The ceramic honeycomb filter according to claim 48, wherein said continuous firing furnace is configured such that: in said muffle, the inert gas mainly flows from the outlet side toward the inlet side.

50. The ceramic honeycomb filter according to claim 48, wherein said continuous firing furnace is configured such that: in said muffle, the gas is discharged: from a high-temperature portion in the furnace; or from a portion sited at the inlet side relative to said high-temperature portion in the furnace.

51. The ceramic honeycomb filter according to claim 48, wherein said continuous firing furnace further comprises a cooling furnace member placed at the outside of said heat insulating layer, and the inert gas flows through: a space between said heat insulating layer and said cooling furnace member; a space between said muffle and said heat insulating layer; and a space inside the muffle, in sequence.

52. The ceramic honeycomb filter according to claim 48, wherein the pressure inside said continuous firing furnace is lowered: in the space between the heat insulating layer and the cooling furnace member; in the space between the muffle and said heat insulating layer; and in the space inside the muffle, in sequence.

* * * * *